United States Patent [19]

Jenkins, Jr. et al.

[11] 4,174,618

[45] Nov. 20, 1979

[54] DECOUPLED CASCADE CONTROL SYSTEM

[75] Inventors: Theron W. Jenkins, Jr., Ambler; Justus C. Barber, King of Prussia, both of Pa.

[73] Assignee: Leeds & Northrup Company, North Wales, Pa.

[21] Appl. No.: 892,537

[22] Filed: Apr. 3, 1978

[51] Int. Cl.[2] ..... F01K 13/02

[52] U.S. Cl. ..... 60/664

[58] Field of Search ..... 60/664, 665, 667; 122/448, 449

[56] References Cited

U.S. PATENT DOCUMENTS

| | | | |
|---|---|---|---|
| 3,802,189 | 4/1974 | Jenkins | 60/665 |
| 3,896,623 | 7/1975 | Daniels | 60/665 |
| 4,064,699 | 12/1977 | Martz | 60/667 X |

FOREIGN PATENT DOCUMENTS

| | | | |
|---|---|---|---|
| 282571 | 4/1971 | U.S.S.R. | 60/664 |

*Primary Examiner*—Allen M. Ostrager
*Assistant Examiner*—Stephen F. Husar
*Attorney, Agent, or Firm*—William G. Miller, Jr.; Raymond F. MacKay

[57] ABSTRACT

Control of the throttle pressure in a drum boiler-turbine system is accomplished by controlling the rate of fuel feed with a cascade control system. When fuel feed cannot be directly measured, but is computed from boiler output, the controllers in the system are decoupled to prevent their interaction. The primary control responds to throttle pressure deviation to produce a heat release demand signal which is compared to the calculated heat release. A signal produced by summing components of the heat release calculation, namely steam flow and rate of change of drum pressure, is used to cancel out any contribution to the input to the primary controller by changes in throttle pressure resulting from disturbances in the fuel feed, which disturbances will be corrected by the secondary or fuel feed controller.

6 Claims, 2 Drawing Figures

GENERATION CONTROL
PRIMARY CONTROLLER
SECONDARY CONTROLLER
$P_s$
$P_t$
$P_T$
$P_1$
$P_d$
V
$dP_d/dt$
BD
K
$\frac{d}{dt}$

DECOUPLED CASCADE CONTROL SYSTEM

BACKGROUND OF THE INVENTION

This invention relates to a cascade control system for controlling the throttle pressure in a boiler-turbine system where the boiler is of the drum type and the control is to be executed by modifying the rate of fuel feed to the boiler. In the fuel supply systems for many boilers, it is difficult to make a direct measurement of the rate at which the heat is supplied to the boiler and it is therefore necessary to make an inferential measure of the heat input. One such method involves measuring the boiler output as by measuring turbine first stage pressure as an indication of steam flow or by measuring the megawatts from the connected generator. Such inferential measurements are proportional to the heat input only under steady state conditions and therefore the measurement must be modified by the addition of a quantity indicative of the changes in energy storage. Thus, the steam generator output plus the rate of change in stored energy is proportional to energy input under both steady state and dynamic conditions. That calculated value is considered as a measurement of the heat release or, in other words, the heat input to the boiler.

The heat release measurement mentioned above has been utilized in a cascade control system in which the primary controller responds to the deviation of the throttle pressure from its desired value to produce a set point for the secondary controller indicative of the heat release demand. That set point is then compared with the calculated heat release in the boiler as determined, for example, by summing signals indicative of the steam flow and the rate of change of pressure in the drum. The deviation resulting from that comparison provides an input to the secondary controller which is arranged to operate controls for modifying the rate at which fuel is fed to the boiler such as, for example, by controlling the speed at which a coal mill is operated.

A cascade control system of the type described above is useful in controlling the fuel feed to a boiler in circumstances where it is anticipated that there will be a disturbance in the relationship between the setting of the fuel control and the rate at which heat is supplied. Such a change may occur, for example, when the coal supplied by a coal mill is changed from one grade to another when the grades have a different BTU content.

While the cascade control system described above provides a useful means for modifying the fuel feed to the boiler so as to take into account changes in the fuel feed system such as changes in the quality of the coal supply, it has been found that in that cascade control system the control loop which involves the secondary controller is not substantially faster than the control loop involving the primary controller. Instead both loops have about the same response time and as a result there tends to be an interaction between the two control loops. There may, for example, occur in the primary controller a reset action due to changes in the heat input to the boiler in response to changes in the quality of the coal supplied. However, since these changes should be taken care of by the control loop involving the secondary controller, the reset action accumulated by the primary controller will have to be removed by the action of the secondary controller. Hence, some of the control action taken by the primary controller eventually has to be undone by the secondary controller, thus there is an interaction between the primary and secondary controllers.

It is an object of this invention to provide an improvement in the cascade control system described above which will substantially prevent interaction between the primary and secondary controller when control is called for in response to changes in the fuel supply system which should ideally be handled by the secondary controller without assistance from the primary controller in order to avoid interaction between the controllers.

SUMMARY OF THE INVENTION

The improved cascade control system of this invention serves to control the throttle pressure in a boiler-turbine system where the boiler is of the drum type and the control system includes a primary controller responsive to the deviation of the throttle pressure from its set point for producing a heat release demand signal representing the heat release required to return the throttle pressure to its set point. A secondary controller is included which is responsive to the deviation from that demand signal of a signal representing the existing heat release, which signal is calculated by summing signals representing the steam flow and the rate of change of boiler drum pressure so that the secondary controller produces a control signal for controlling the rate of fuel feed to the boiler. The improvement of the cascade control system of the present invention comprises means responsive to the difference between the heat release demand signal and a signal produced by summing the signal representing steam flow and a portion of the signal representing the rate of change of the boiler drum pressure for modifying the output of the primary controller by an amount sufficient to substantially cancel changes in the primary controller output due to changes in the throttle pressure resulting from changes in that part of the boiler-turbine system producing the heat input to the boiler.

DESCRIPTION OF PREFERRED EMBODIMENTS

Figures 1, 2:
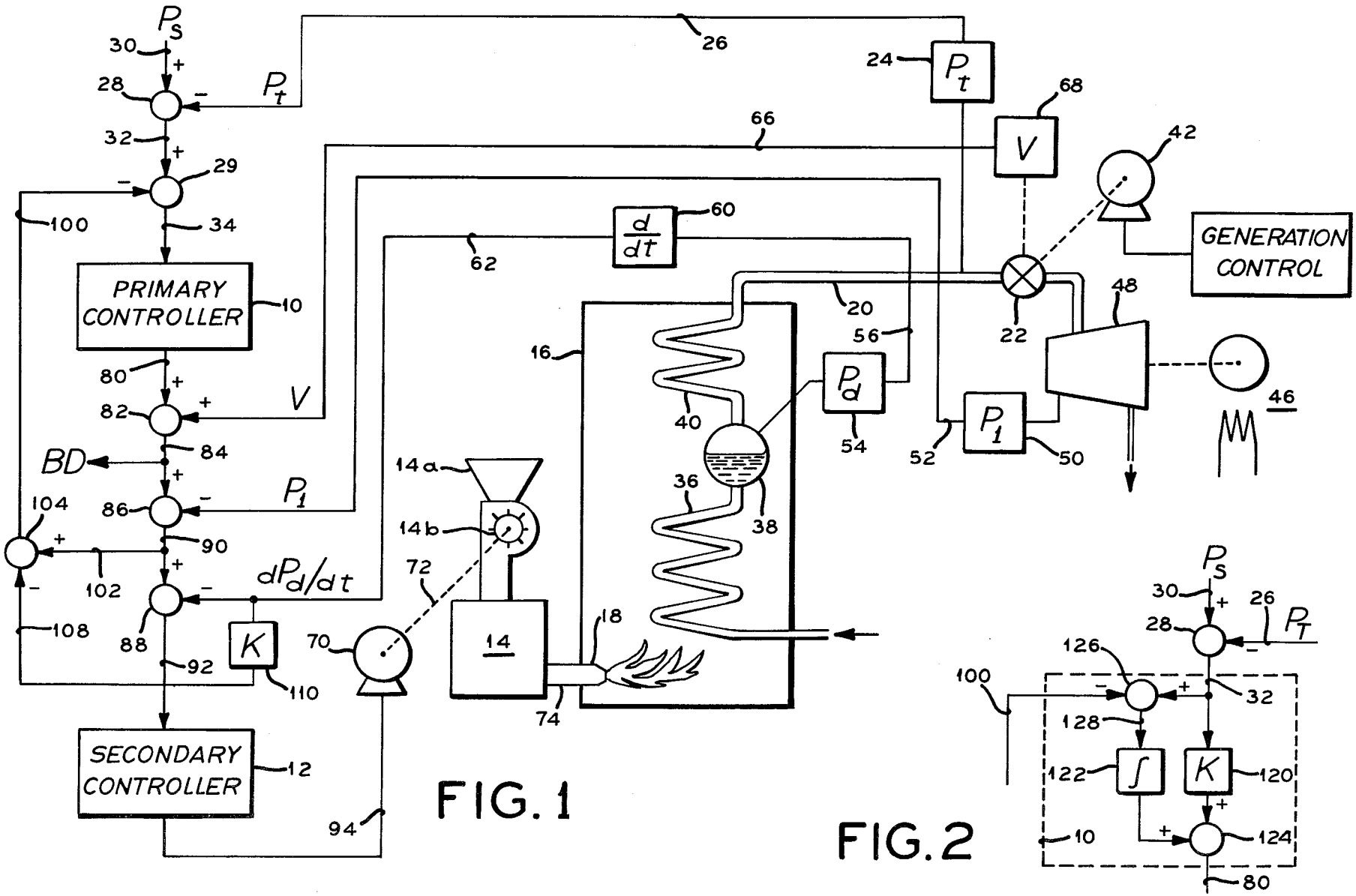
FIG. 1 shows in block diagram form the control system of the present invention.
FIG. 2 shows a modification of the control system of FIG. 1 which is another form of the invention.

In FIG. 1 there is shown one form which the improved cascade control system of the present invention can take. As will be evident from FIG. 1, the cascade control system which includes both the primary controller 10 and the secondary controller 12 is connected so as to control the fuel feed from the pulverizing unit 14 from which coal is delivered to the boiler 16 through burner 18 so as to provide heat input to the boiler for controlling the throttle pressure in the output steam line 20. The throttle pressure $P_t$ is measured ahead of throttle valve 22 by the pressure measuring instrument 24 so as to produce on line 26 a signal indicative of the throttle pressure which can then be compared in comparator 28 with the signal on line 30 indicative of the desired throttle pressure $P_s$ so as to provide from that difference an error signal on line 32 as an input to the primary controller 10.

The boiler-turbine system of FIG. 1 which is being controlled is shown as including within the boiler 16 the tubes 36 into which the feed water flows and in which the feed water is heated so as to provide the input to the drum 38 in which the water level is maintained constant. The steam from the drum 38 is then supplied through the superheater coils 40 to the output steam line 20 which includes the throttle valve 22. The opening of valve 22 is modified by the control motor 42 which is operated in response to the generation control so that the opening of the valve 22 controls the rate at which the steam flows into the turbine 48 and hence the output of the generator 46.

In the computation of heat release as is required for the cascade control system of this invention, one of the components of that calculation is steam flow. That component may be calculated directed as by measuring the steam flow with a flow meter or it may be determined by utilizing a pressure measurement which measures the first stage pressure in the turbine 48. For example, as shown in FIG. 1, the pressure measuring device 50 is used to measure the first stage pressure of turbine 48 so as to provide a signal on line 52, namely $P_1$, indicative of first stage pressure and hence steam flow.

The other component required in the computation of heat release is the rate of change of drum pressure. That component is obtained by utilizing the pressure measuring instrument 54 to measure the pressure in the drum 38 so as to provide on its output line 56 a signal indicative of the drum pressure. That signal is then modified by the rate circuit shown as block 60 so that there is provided on line 62 a signal indicative of the rate of change of the drum pressure, namely $dP_d/dt$.

In order to obtain the best control from the cascade control system of FIG. 1, that control system utilizes a feed-forward signal indicative of the load demand on the boiler-turbine system. In FIG. 1 that signal is provided as a signal on line 66 from the instrument 68 where the instrument 68 is an instrument connected to the valve 22 mechanically and arranged to provide on line 66 a signal indicative of the position of the valve 22. The instrument 68, for example, could be a potentiometer whose setting is positioned by the setting of valve 22. Alternatively the valve opening can be represented by a computed value calculated as $P_1/P_t$. The feedforward signal on line 66 may be identified by the notation V.

The fuel feed to the boiler as shown in FIG. 1 is simplified by showing a signal pulverizing unit 14 and a signal burner 18 whereas normally a boiler will include a plurality of such units. It is understood by those familiar with the firing of boilers, as it is accomplished with coal, that the pulverizing unit 14 is supplied with coal by way of the hopper **14*a* from which the coal is fed by unit 14*b* which is operated at a speed determined by the motor 70 through the mechanical coupling 72. The coal is thus supplied to the pulverizing unit at a rate determined by the motor 70. The coal is supplied from the pulverizing unit to the burner 18 by a fan system (not shown) which forces the pulverized coal from the burner 18 by way of line 74**.

Considering now the operation of the cascade control system for the control of fuel fed to the burner 16 as shown in FIG. 1, the primary controller responds to the error signal on line 32 which represents the deviation of the throttle pressure $P_t$ from the throttle pressure set point $P_s$ as determined by the comparator 28. The primary controller may be any of a number of standard control systems which usually include both proportional and reset action so that there is produced on its output line 80 a signal representative of the required change in the heat release demand. That change in heat release demand in boiler 16 is the change required to return the throttle pressure to its set point. The signal on line 80, modified by the addition of the feedforward signal V is indicative of the load demand on the boiler-turbine system and may be considered the set point for the secondary controller. Thus, signal V is added to the signal on line 80 by the summing circuit 82 so as to provide on line 84 a heat release demand signal which may be considered a boiler demand signal BD which is, in turn, compared with the calculated heat release presently existing in boiler 16.

By means of the comparators 86 and 88 the heat release demand is compared to the calculated heat release. The first comparator 86 receives the steam flow signal as represented by the signal $P_1$, and the second comparator 88 receives the result of that previous comparison on line 90 for comparison with the rate of change of drum pressure as supplied on line 62. The result of these two comparisons by comparators 86 and 88 is essentially a comparison of the modified heat release demand signal on line 84 with the actual heat release in the boiler 16 calculated as the sum of $P_1$ and the $dP_d/dt$ so that there is then supplied on line 92 an error signal indicative of the deviation of the calculated heat release from the heat release demand. Thus, the signal on line 92 is an error signal forming the input to the secondary controller 12. The secondary controller 12 then provides an output on line 94 which serves to control the speed of motor 70 to thereby modify the rate of supply of coal to the pulverizer 14 and hence to modify the fuel feed to the burner 18.

The cascade control system as thus far described has been utilized in the control of fuel feed to boilers of the drum type as shown in FIG. 1 and, as previously mentioned, there has been a resultant interaction between the controllers in the system, namely controllers 10 and 12, which provides undesirable results. In order to prevent that interaction there is provided a means for modifying the output of the primary controller so as to cancel changes which would occur in the primary controller output due to changes in the throttle pressure $P_t$ resulting from the changes in the heat producing part of the boiler system. For instance, such changes may occur in the quality of the coal supplied to the pulverizer 14. The modifying means in FIG. 1 is the signal supplied on line 100 which is supplied as one input to the comparator 29 and which is of a magnitude such that it tends to cancel changes in the signal on line 26 indicative of the changes in the throttle pressure $P_t$ which result from disturbances in that part of the boiler turbine system which supplies heat to the boiler as mentioned previously.

In order to obtain the desired signal on line 100, it is necessary to utilize a signal such as the signal on line 102 which is responsive to the changes in the steam flow as measured by the first stage pressure $P_1$. Thus the signal on line 102 may be obtained from line 90 which carries a signal representing the difference between the heat release demand and the steam flow. That signal on line 102 is further modified by comparator unit 104 to subtract the signal which appears on line 108 which represents a portion of the signal on line 62 and hence an attenuation factor times the rate of change of the drum pressure with the factor being determined by the circuitry in block 110 which provides the proportionality factor K as a multiplier for the signal on line 62. Thus the signal on line 100 represents a signal which varies with the deviation from the boiler demand of the quantity $P_1+K\ (dP_d/dt)$.

If we assume, for example, that the quality of coal fed to the hopper 14a is modified so as to contain less BTUs per unit volume, it will be evident that there will be a resultant reduction in the throttle pressure $P_t$ as a result of the reduction in the heat supply. There will also be a reduction in steam flow as measured by the first stage pressure $P_1$, as well as a reduction in the drum pressure as measured by instrument 54, namely $P_d$.

The rate of change of $P_d$ as indicated by the signal on line 62 when combined with the change in $P_1$ which appears on line 52 will be effective to provide a change in the signal proportional to the change in actual heat release. Each signal change would generally be opposite to the change detected in $P_t$ as that change appears on line 26 so that the signal change on line 100 will serve to cancel the signal change on line 26, thus maintaining the error signal input to primary controller 10 unchanged, so that the primary controller does not respond to changes in fuel quality. However, the secondary controller 12 will respond to these changes in that the error input to the secondary controller 12 appearing on line 92 will be modified by the changes in the signals on the lines 62 and 52, thus the secondary controller will effectively control the rate at which the coal is supplied to the burner 18 so as to correct for the changes which occur in the heat input to the boiler as a result of the change to the fuel quality.

Utilizing the decoupling signal supplied on line 100, the cascade control system is enabled to operate in a manner most effective for the control of boiler 16 in that the secondary controller responds to disturbances in the fuel feed system as it relates to the heat input to the boiler and responses by the primary controller for such changes and disturbances is substantially prevented, thus avoiding interaction between the primary and secondary controllers.

While the arrangement of FIG. 1 shows the use of the signal on line 100 as a means for cancelling out changes in the signal on line 26, the output of the primary controller may be changed in response to variations in the signal on line 100 in other ways. For example, the signal on line 100 may be utilized to modify the reset of the primary controller 10 as shown in FIG. 2. The primary controller 100, shown as having a circuit 120 which provides the proportional response K to the controller 10 and another circuit shown as block 122 which provides the integral response for the controller 10. The proportional response and the integral or reset resonse are combined in controller 10 by the summing circuit 124 so that there is provided the output on line 80 from 124. In FIG. 2 the line 100 is shown as supplying its signal in opposition to the error signal supplied on line 32 in that the signal from line 100 is supplied as a signal to comparator 126 which compares the signal on line 100 with that on line 32 and provides as an output on line 128 the signal to be integrated by circuit 122 so as to provide the reset junction. Thus, the arrangement of FIG. 2 serves to prevent a reset windup in the primary controller 10 whenever there is a change in the relationship of the rate of the fuel feed and heat input to the boiler due to a disturbance in the fuel supply system such as a change in fuel quality.

It is desirable to provide in circuit 110 means for adjusting the proportionality constant K so that the signal on line 100 can be modified to provide the optimum operation of the control system with minimization interaction between the primary and secondary controllers.

What is claimed is:

1. In a cascade control system for controlling the steam boiler of the drum type wherein a primary controller having proportional and reset action responds to the deviation of the throttle pressure from its set point to establish as an output a set point value representing heat release demand with a secondary controller responding to the deviation of the calculated existing heat release from the demand value represented by said set point to control the fuel input to the boiler, the improvement which comprises:

means responsive to the difference between the heat release demand and the existing steam flow to modify the output of said primary controller by an amount sufficient to cancel any changes in said output due to changes in the throttle pressure resulting from disturbances which are detectable as changes in the existing steam flow.

2. In a cascade system for controlling a steam boiler of the drum type wherein a primary controller having proportional and reset action responds to the deviation of the throttle pressure from its set point to establish as an output a set point value representing heat release demand with a secondary controller responding to the deviation of the calculated existing heat release from the demand value represented by said set point to control the fuel input to the boiler, the improvement which comprises:

means responsive to the difference between the heat release demand and the sum of the existing steam flow and the rate of change of the steam pressure in said drum to modify the output of said primary controller by an amount sufficient to cancel any changes in said output due to changes in the throttle pressure resulting from disturbances which are detectable as changes in said sum.

3. In a cascade control system for controlling the throttle pressure in a boiler-turbine system wherein the boiler is of the drum type and the control system includes a primary controller responsive to the deviation of said throttle pressure from a set point for producing a signal representing the heat release demand required to maintain said throttle pressure at its set point and a secondary controller responsive to the deviation from said demand signal of a signal representing the existing heat release in said boiler as calculated from a signal representing steam flow and a signal representing the rate of change of boiler drum pressure so that the secondary controller produces a control signal for controlling the rate of fuel feed to the boiler, the improvement comprising:

means responsive to the difference between the heat release demand signal and a signal produced by summing the signal representing steam flow and a portion of the signal representing the rate of change of the boiler drum pressure for modifying the output of said primary controller by an amount sufficient to substantially cancel changes in said primary controller output due to changes in the throttle pressure resulting from changes in that part of the boiler turbine system producing the heat input to the boiler.

4. Apparatus as set forth in claim 3 in which the modification of the output of the primary controller is produced by modifying said first mentioned deviation.

5. Apparatus as set forth in claim 3 in which the modification of the output of the primary controller is produced by modifying its reset action.

6. Apparatus as set forth in claim 3 in which the signal representing steam flow is produced from a measurement of the pressure in the first stage of the turbine.

* * * * *